United States Patent [19]

Ono et al.

[11] Patent Number: 4,993,390

[45] Date of Patent: Feb. 19, 1991

[54] INJECTOR POSITIONING DEVICE

[75] Inventors: Takashi Ono; Hiroyuki Nishizawa; Akira Takahashi, all of Kyoto, Japan

[73] Assignee: Mitsubishi Jidosha Kogyo Akbushiki Kaisha, Tokyo, Japan

[21] Appl. No.: 356,439

[22] Filed: May 23, 1989

[30] Foreign Application Priority Data

May 27, 1988 [JP] Japan ..... 63-69340[U]

[51] Int. Cl.[5] ..... F02M 39/00

[52] U.S. Cl. ..... 123/470; 123/468; 123/456; 239/600; 239/551

[58] Field of Search ..... 123/470, 471, 472, 468, 123/469, 456; 239/600, 551

[56] References Cited

U.S. PATENT DOCUMENTS

| | | | |
|---|---|---|---|
| 2,995,123 | 8/1961 | Goschel | 123/470 |
| 4,294,215 | 10/1981 | Hans | 123/470 |
| 4,307,693 | 12/1981 | Glockler | 123/470 |
| 4,334,512 | 6/1982 | Biernath | 123/469 |
| 4,474,160 | 10/1984 | Gartner | 123/468 |
| 4,475,516 | 10/1984 | Atkins | 123/420 |
| 4,556,034 | 12/1985 | Anklam | 123/470 |
| 4,693,223 | 9/1987 | Eshleman | 123/470 |
| 4,773,374 | 9/1988 | Kiuchi | 123/470 |
| 4,805,564 | 2/1989 | Hudson | 123/470 |
| 4,823,754 | 4/1989 | Minamoto | 123/456 |

FOREIGN PATENT DOCUMENTS

| | | | |
|---|---|---|---|
| 0294586 | 12/1988 | European Pat. Off. | 123/470 |
| 3014066 | 10/1981 | Fed. Rep. of Germany | 123/470 |
| 0678194 | 8/1979 | U.S.S.R. | 123/470 |

*Primary Examiner*—Carl Stuart Miller

*Attorney, Agent, or Firm*—Abelman, Frayne, Rezac & Schwab

[57] ABSTRACT

Disclosed is a device for positioning an injector in its circumferential direction so that a plurality of nozzle holes formed at one end of the injector connected at the other end to a delivery pipe in an internal combustion engine can be accurately directed toward corresponding intake ports respectively. The device comprises a clip non-rotatably mounted on part of the delivery pipe, and the clip includes retaining portions extending along diametrically opposite wall portions of the injector and having confronting projections adapted to engage mating holes bored in the diametrically opposite wall portions respectively of the injector thereby positioning the injector.

4 Claims, 4 Drawing Sheets

INJECTOR POSITIONING DEVICE

BACKGROUND OF THE INVENTION

1. Field of the Invention

This invention relates to a device incorporated in an internal combustion engine of a vehicle for positioning an injector having a plurality of nozzle holes.

2. Description of the Related Art

A multi-valve arrangement is now put into practice in an internal combustion engine for a vehicle for the purpose of improving the operation performance of the engine, and also a gasaline injection method of directly injecting fuel by an injector is now widely employed in such an engine for the purpose of preventing environmental pollution and improving the fuel consumption.

When the direct gasaline injection method described above is applied to the multi-valve engine described above so that one injector injects fuel into a plurality of associated intake valves disposed in a fuel system of the engine, it is necessary to inject the fuel toward and into the individual intake valves uniformly or at a predetermined rate. Because of the above requirement, it is a common practice that the injector is provided with fuel nozzle holes in a number equal to the number of the intake valves so that the fuel can be injected from the nozzle holes toward and into the corresponding intake valves.

An example of such a concept is schematically shown in FIG.6. It will be seen in FIG.6 that an injection 3 having three nozzle holes 3*a*, 3*b* and 3*c* injects fuel toward and into a combustion chamber 2 having three intake valves 1*a*, 1*b* and 1*c*. In FIG.6, the reference numerals 4*a*, 4*b* and 4*c* designate intake ports communicating with the respective intake valves 1*a*, 1*b* and 1*c*, and 5 designates an intake manifold.

In such a fuel system, the individual nozzle holes 3*a*, 3*b* and 3*c* of the injector 3 are required to be accurately directed toward the respective intake ports 4*a*, 4*b* and 4*c*. Therefore, various devices for accurately positioning the injector 3 in its circumferential direction have been proposed hitherto. For example, JP-U-60-84767, JP-U-60-137168, JP-U-60-173674, JP-U-60-173675, JP-U-61-41864, JP-U-61-86569 and JP-U-61-88061 disclose such devices.

However, the devices disclosed in those publications have had such various problems that rubber packings tend to be distorted during assembling, the injector itself requires a special structure, the injector itself requires special mechanical processing, and the devices themselves become complex in structure.

SUMMARY OF THE INVENTION

With a view to solve the above problems encountered with the prior art injector positioning devices, it is an object of the present invention to provide a device for accurately positioning an injector in its circumferential direction by a simple and convenient means without requiring any especial mechanical processing on the injector itself.

In accordance with the present invention which attains the above object, there is provided a device for positioning an injector in its circumferential direction so that a plurality of nozzle holes formed at one end of the injector connected at the other end to a delivery pipe in an internal combustion engine can be accurately directed toward corresponding intake ports respectively, the device comprising a clip non-rotatably mounted on part of the delivery pipe, the clip including retaining portions, having confronting projections adapted to engage mating holes bored in diametrically opposite wall portions respectively of the injector thereby positioning the injector.

Since the clip is mounted so as not to be rotatable relative to the delivery pipe, it is located in the position where it is restricted against rotation, and, since the projections projecting from the retaining portions of the clip engage the mating holes bored in the diametrically opposite wall portions of the injector in the state in which the clip is located in the position where the clip is restricted against rotation, the injector can be accurately positioned in its circumferential direction.

Therefore, according to the injector positioning device of the present invention, the injector can be accurately positioned in its circumferential direction by merely using a clip of a special shape and without applying any especial mechanical processing to the injector itself. Also, the efficiency of assembling can be improved because the injector can be positioned by simple steps of manipulation including mounting the clip on a branch pipe of the delivery pipe and engaging the projections of the clip with the mating holes of the injector.

DETAILED DESCRIPTION OF THE PREFERRED EMBODIMENTS

Figure 1:
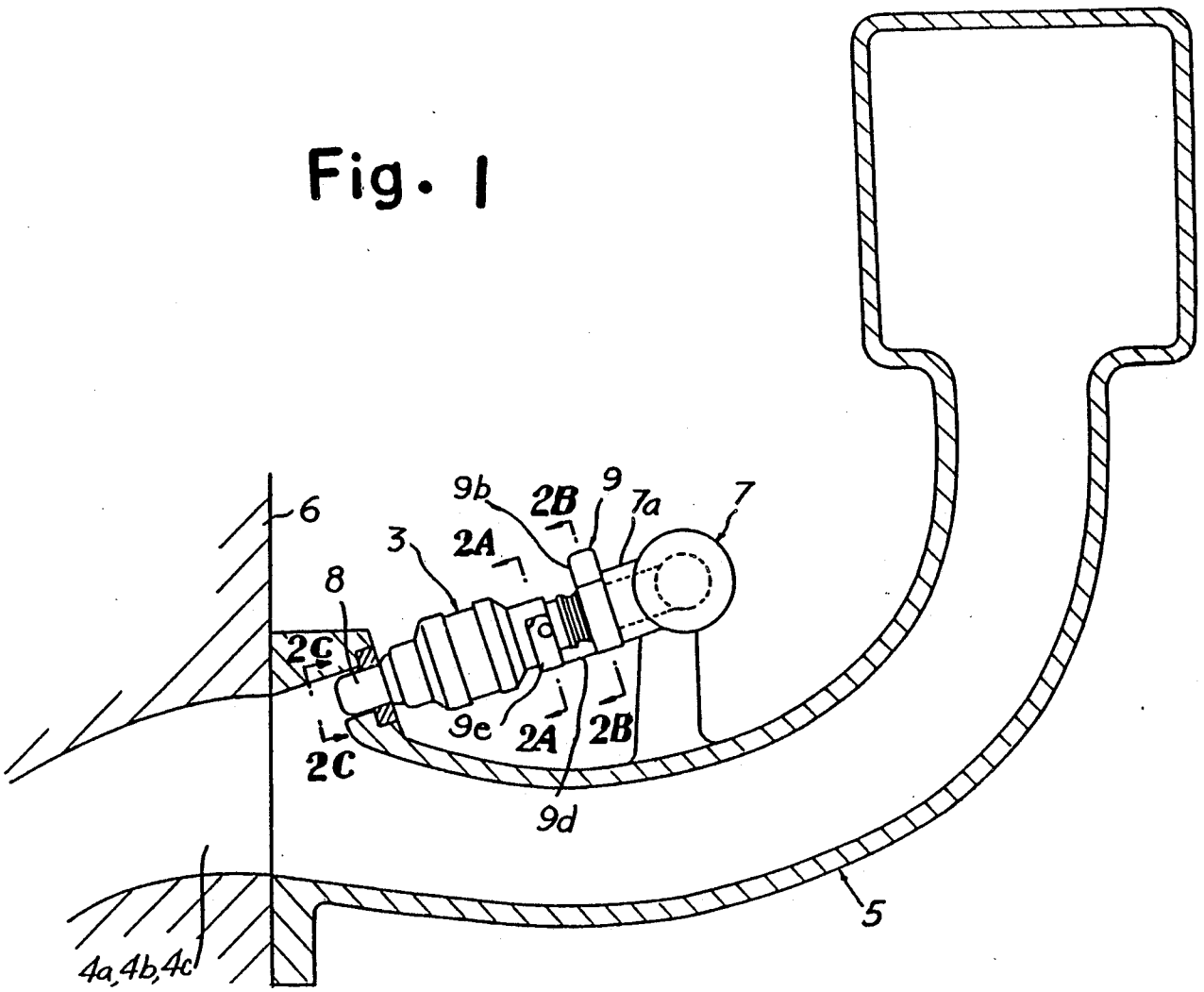
FIG.1 is a partly sectional, side elevation view of a state in which an injector is positioned by a preferred embodiment of the injector positioning device according to the present invention.

Referring to FIG.1, a delivery pipe 7 is supported above an intake manifold 5 connected to a cylinder head 6 of an internal combustion engine. Fuel contained in a fuel tank (not shown) is pumped up by a fuel pump (not shown) and fed through a fuel filter (not shown) to the delivery pipe 7. The pressure of the fuel is regulated to a predetermined high level by a pressure regulator (not shown).

Figure 6:
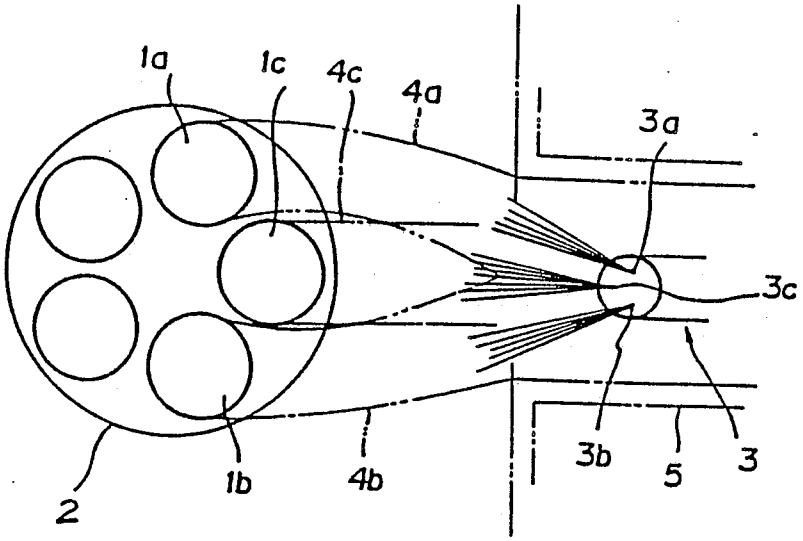
FIG.6 is a conceptual diagram showing the relation between the intake valves and the nozzle holes of the injector.

A plurality of branch pipes 7*a* are integrally connected to the delivery pipe 7, and the number of these branch pipes 7*a* is equal to the number of cylinders of the engine. Injectors 3 are connected at their rear ends to the individual branch pipes 7*a* respectively so that the fuel supplied to the delivery pipe 7 is distributed to the individual injectors 3. Each injector 3 has a nozzle 8 at its front end, and the nozzle 8 extends into the intake manifold 5 to be directed toward intake ports 4*a*, 4*b* and 4*c* in the cylinder head 6, as best shown in FIG.6. The nozzle 8 is formed with a plurality of (three in the case of FIG.1) nozzle holes 3*a*, 3*b* and 3*c* as described already. The position of the injector 3 in its circumferential direction is determined so that these nozzle holes 3*a*, 3*b* and 3*c* can be directed toward the corresponding intake ports 4*a*, 4*b* and 4*c* respectively.

Figure 2A:
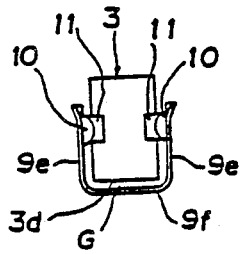
FIGS.2A, 2B and 2C are views taken along the lines A—A, B—B and C—C respectively in FIG.1.
Figure 2B:
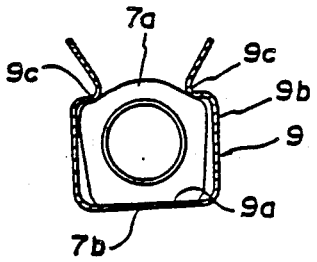
Figure 2C:
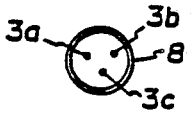
Figure 3A:
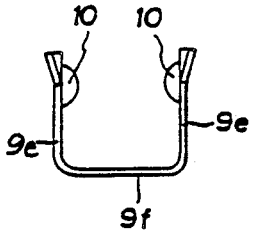
FIGS.3A, 3B, 3C and 3D are a left-hand side elevation view, a front elevation view, a right-hand side elevation view and a bottom plan view respectively of the clip shown in FIG.1.
Figure 3B:
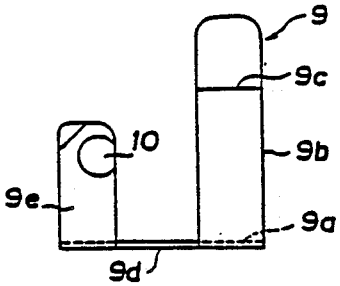
Figure 3C:
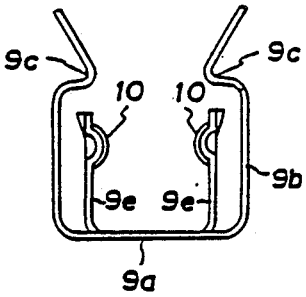
Figure 3D:
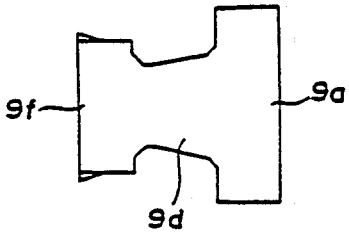

Each branch pipe 7*a* branched from the delivery pipe 7 is formed with a flat portion 7*b* as shown in FIG.2B. A clip 9 having a shape and a structure as shown in FIGS.3A to 3D is mounted on each of the branch pipes 7*a*. This clip 9 is fitted at a flat portion 9*a* of its clipping portion 9*b* on the flat portion 7*b* of the branch pipe 7*a*, so that the clipping portion 9*b* of the clip 9 makes clipping engagement with the branch pipe 7*a*. The clip 9 is made of a material such as a spring steel. The clipping portion 9*b* includes a pair of holding or retaining portions 9*c* opposing the flat portion 9*a*. These retaining portions 9*c* make resilient retaining engagement with the upper surface (the surface opposite to the flat portion 7*b*) of the branch pipe 7*a* so that the clip 9 is firmly resiliently mounted on the branch pipe 7*a*. Thus, the attitude of the clip 9 is determined by the resilient retaining engagement of the retaining portions 9*c* with the upper surface of the branch pipe 7*a*.

An integral connecting portion 9*d* terminating in a flat portion 9*f* extends from the flat portion 9*a* of the clip 9 in a relation located forward of the clipping portion 9*b*, that is, toward the nozzle 8 of the injector 3, and a pair of integral holding or retaining portions 9*e* extend in the form of a U from the flat portion 9*f* in parallel to the clipping portion 9*b*. These retaining portions 9*e* extend upward from the flat portion 9*f* along the diametrically opposite wall portions of the injector 3, and a pair of opposing or confronting semispherical projections 10 are provided at upper inner positions of the retaining portions 9*e* respectively.

On the other hand, a pair of holes 11 are previously bored in the diametrically opposite wall portions of the injector 3 so that a tool for adjusting the amount of injected fuel can be inserted into these holes 11 in the final step of the injector manufacturing process. The semispherical projections 10 provided on the upper inner positions of the retaining portions 9*e* of the clip 9 are resiliently fitted in these holes 10 respectively as shown in FIG.2A by the resiliency of the material of the clip 9. The positional relation between the nozzle holes 3*a*, 3*b*, 3*c* of the nozzle 8 of the injector 3 and the mating holes 11 bored in the diametrically opposite wall portions of the injector 3 is previously known. Therefore, when the projections 10 of the clip 9 are fitted in the respective mating holes 11 of the injector 3 to restrain the attitude of the injector 3 in the circumferential direction, the nozzle holes 3*a*, 3*b* and 3*c* of the nozzle 8 of the injector 3 can be directed toward the individual intake ports 4*a*, 4*b* and 4*c* respectively. The injector 3 need not be subjected to any especial mechanical processing because the tool insertion holes 11 bored in the diametrically opposite wall portions of the injector 3 are directly utilized for attaining the desired alignment of the nozzle holes 3*a*, 3*b* and 3*c* with the individual intake ports 4*a*, 4*b* and 4*c* respectively.

A gap G as shown in FIG.2A is formed between the flat bottom portion 9*f* of the retaining portions 9*e* and the confronting lower surface 3*d* of the injector 3, so as to avoid such an undesirable trouble that the projections 10 of the clip 9 cannot be fitted into the mating holes 11 of the injector 3 due to, for example, a clip manufacturing error.

In the aforementioned embodiment, the flat portion 9*a* of the clip 9 is brought into face-to-face engagement with the flat portion 7*b* of the branch pipe 7*a* so as to determine the mounting position of the clip 9 relative to the delivery pipe 7. However, the manner of determining the mounting position of the clip 9 relative to the delivery pipe 7 is in no way limited to that described above, because the sole requirement is that the clip 9 is to be mounted so as not to be rotatable relative to the delivery pipe 7. Thus, there are various manners of clip mounting utilizing the shape and dimensions of the delivery pipe 7, and the shape and structure of the clip may be correspondingly changed.

In the aforementioned embodiment, the present invention is applied to an injector having three nozzle holes. However, it is apparent that the present invention is equally effectively applicable to an injector having two or more nozzle holes in addition to that having three nozzle holes.

Figure 4A:
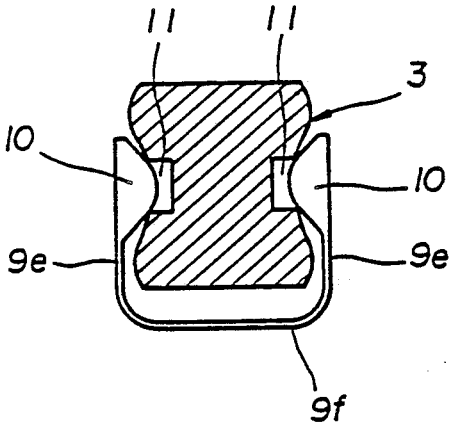
FIGS.4A and 4B are a sectional view similar to FIG.2A and a detailed perspective view respectively in another embodiment of the present invention.
Figure 4B:
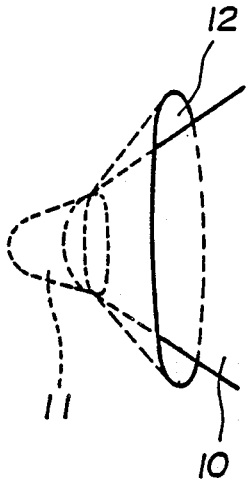
Figure 5A:
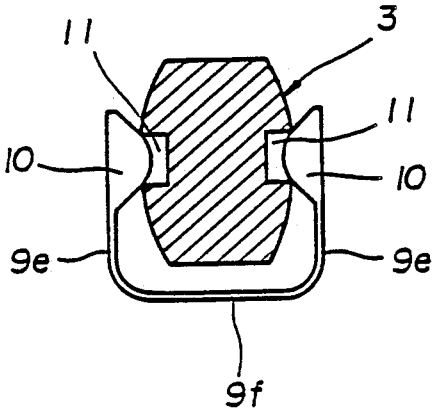
FIGS.5A and 5B are a sectional view similar to FIG.2A and a detailed perspective view respectively in still another embodiment of the present invention.
Figure 5B:
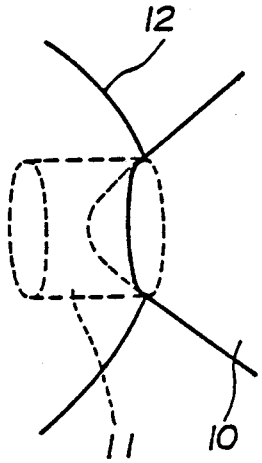

The fitting engagement between the projections 10 provided at the upper inner positions of the retaining portions 9*e* of the clip 9 and the mating holes 11 bored in the diametrically opposite wall portions of the injector 3 may be modified as shown in FIGS.4A and 4B. Referring to FIGS.4A and 4B, the injector 3 has concave diametrically opposite wall portions 12, and the holes 11 mating with the projections 10 of the clip 9 are bored in such wall portions 12. Another modification is shown in FIGS.5A and 5B. Referring to FIGS.5A and 5B, the injector 3 has convex diametrically opposite wall portions 12, and the holes 11 mating with the projections 10 of the clip 9 are bored in such wall portions 12. In FIGS.4A and 5A, the internal structure of the injector 3 is not illustrated.

We claim:

1. A device for positioning an injector in a predetermined mounted state so that a plurality of nozzle holes formed at one end of the injector connected at the other end to a delivery pipe in an internal combustion engine can be accurately directed toward corresponding intake ports respectively, said device comprising a clip non-rotatably mounted on part of said delivery pipe, said clip including retaining portions extending along diametrically opposite wall portions of said injector and having confronting projections adapted to engage mating holes bored in the diametrically opposite wall portions respectively of said injector thereby positioning said injector.

2. An injector positioning device according to claim 1, wherein said mating holes bored in the diametrically opposite wall portions of said injector serve also to permit insertion of a tool for adjusting the amount of injected fuel.

3. An injector positioning device according to claim 1, wherein said diametrically opposite wall portions of said injector having said mating holes bored therein are concave in configuration.

4. An injector positioning device according to claim 1, wherein said diametrically opposite wall portions of said injector having said mating holes bored therein are convex in configuration.

* * * * *

UNITED STATES PATENT AND TRADEMARK OFFICE

CERTIFICATE OF CORRECTION

PATENT NO. : 4,993,390

DATED : February 19, 1991

INVENTOR(S) : ONO ET AL

It is certified that error appears in the above-indentified patent and that said Letters Patent is hereby corrected as shown below:

On the title page: Item [73] Assignee

"MITSUBISHI JIDOSHA KOGYO AKBUSHIKI KAISHA" is amended to read --MITSUBISHI JIDOSHA KOGYO KABUSHIKI KAISHA --.

Signed and Sealed this

Eighth Day of February, 1994

*Attest:*

Bruce Lehman

BRUCE LEHMAN

*Attesting Officer*

*Commissioner of Patents and Trademarks*